US009203141B1

(12) United States Patent
Su et al.

(10) Patent No.: US 9,203,141 B1
(45) Date of Patent: Dec. 1, 2015

(54) COMMUNICATION DEVICE AND ANTENNA THEREOF

(71) Applicant: KING SLIDE TECHNOLOGY CO., LTD., Kaohsiung (TW)

(72) Inventors: Hsin-Cheng Su, Kaohsiung (TW); Chun-Ta Liu, Kaohsiung (TW); Shu-Chen Lin, Kaohsiung (TW)

(73) Assignee: KING SLIDE TECHNOLOGY CO., LTD., Kaohsiung Science Park, Lu Zhu Dist., Kaohsiung (TW)

( * ) Notice: Subject to any disclaimer, the term of this patent is extended or adjusted under 35 U.S.C. 154(b) by 55 days.

(21) Appl. No.: 14/302,418

(22) Filed: Jun. 11, 2014

(51) Int. Cl.
*H01Q 1/24* (2006.01)
*H01Q 7/00* (2006.01)

(52) U.S. Cl.
CPC . *H01Q 1/243* (2013.01); *H01Q 7/00* (2013.01)

(58) Field of Classification Search
USPC ..... 343/702
See application file for complete search history.

(56) References Cited

U.S. PATENT DOCUMENTS

| | | | | |
|---|---|---|---|---|
| 8,054,231 | B2 | 11/2011 | Ahn | |
| 8,253,633 | B2 * | 8/2012 | Sanz | H01Q 1/243 343/700 MS |
| 8,432,321 | B2 | 4/2013 | Arkko | |
| 2004/0257283 | A1 | 12/2004 | Asano | |
| 2007/0030204 | A1 | 2/2007 | Heng | |
| 2007/0290944 | A1 | 12/2007 | Takaki | |
| 2008/0316115 | A1 * | 12/2008 | Hill | H01Q 1/243 343/702 |
| 2011/0199265 | A1 * | 8/2011 | Lin | H01Q 1/2266 343/700 MS |
| 2012/0223865 | A1 | 9/2012 | Li | |
| 2013/0210504 | A1 | 8/2013 | Mareno | |
| 2014/0197997 | A1 * | 7/2014 | Yang | H01Q 1/243 343/702 |

* cited by examiner

*Primary Examiner* — Tan Ho
(74) *Attorney, Agent, or Firm* — Winston Hsu; Scott Margo

(57) ABSTRACT

A communication device comprises a front housing, a back cover, a main body, a display panel, a signal feed point, a ground point, an antenna and a conductor. The main body is located between the front housing and the back cover. The antenna is installed on the main body and corresponding to an adjacent edge of the display panel. The antenna comprises a first metal part and a second metal part. The first metal part is coupled to the signal feed point, and the second metal part is coupled to the ground point. A coupling gap is defined between the conductor and the antenna, and at least one part of the conductor corresponds to the display panel.

12 Claims, 7 Drawing Sheets

COMMUNICATION DEVICE AND ANTENNA THEREOF

BACKGROUND OF THE INVENTION

1. Field of the Invention

The present invention relates to an antenna of a communication device, and more particularly, to a metal housing being utilized as an antenna of a communication device, for emitting and receiving radio signals of the communication device.

2. Description of the Prior Art

During product development processes of conventional communication devices, such as mobile communication products, plastic housings are mainly used by manufacturers due to cost concerns, in order to maintain basic radiation characteristics of an antenna. However, a trend of metal housing is currently brought by Apple iPhones and Macbooks. Since the metal housing has light weight, good heat dissipation, high strength, high impact resistance, good looking, anti-electromagnetic and recyclable characteristics, the metal housing is getting more and more popular. Therefore, the metal housings are mainly used in development of new generations of the mobile communication products. For example, U.S. Pat. No. 8,054,231 B2 disclosed by Ahn et al. teaches a metal case having a slot, which can be used as a slot antenna of a mobile device. But the slot may obviously ruin appearance of the metal case, and the slot needs to be arranged at a position corresponding to a specific area of the metal case. Therefore, it is important to design a proper antenna to allow electromagnetic waves to penetrate the metal case for achieving communication purposes without obviously ruining the appearance of the metal case. In addition, when the metal case is replaced by a plastic case for cost reduction, performance of the antenna needs to be maintained as well. Therefore, it is also important to provide an antenna applicable to both the metal case and plastic case of the mobile communication product.

SUMMARY OF THE INVENTION

The present invention relates to a communication device utilizing an antenna arrangement as a radiating unit, for guiding electromagnetic radiation energy to a display panel of the communication device, so as to improve signal transmitting and receiving capability of the antenna.

According to an embodiment of the present invention, a communication device comprises a front housing; a display module; a display panel installed between the display module and the front housing; a back cover made of metal or plastic; a main body located between the front housing and the back cover, the main body being made of a non-conductive material; a signal feed point; a ground point; an antenna installed on the main body, the antenna comprising a first metal part, a second metal part and a third metal part extended and connected between the first metal part and the second metal part, wherein the first metal part of the antenna is coupled to the signal feed point, and the second metal part of the antenna is coupled to the ground point; and a conductor, wherein a coupling gap is defined between the conductor and the antenna, at least one part of the conductor corresponds to the display panel, the conductor comprises a first conductive part, a second conductive part coupled to the first conductive part, and a slit is formed on the second conductive part.

Preferably, the front housing substantially is a rectangular frame defining a window, and the display panel corresponds to the window of the front housing.

Preferably, the front housing is made of a metal material.

Preferably, the display panel is made of glass.

Preferably, the back cover is made of a metal material and coupled to the ground point.

Preferably, the first metal part, the second metal part and the third metal part of the antenna together form an approximate loop antenna trace.

Preferably, the antenna corresponds to an edge of the display panel adjacent to the antenna.

Preferably, the third metal part of the antenna comprises a first wire section, a second wire section, a third wire section and a fourth wire section, wherein the first wire section is substantially parallel to the back cover, the second wire section is extended and connected between the first wire section and the third wire section, at least one part of the second wire section crosses the main body and is substantially perpendicular to the back cover, the fourth wire section is connected to the third wire section, at least one part of the fourth wire section crosses the main body and is substantially perpendicular to the back cover.

Preferably, the communication device further comprises a connection terminal coupled to the ground point, wherein at least one part of the connection terminal corresponds to the back cover, when the back cover is installed on the main body, the back cover contacts the connection terminal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
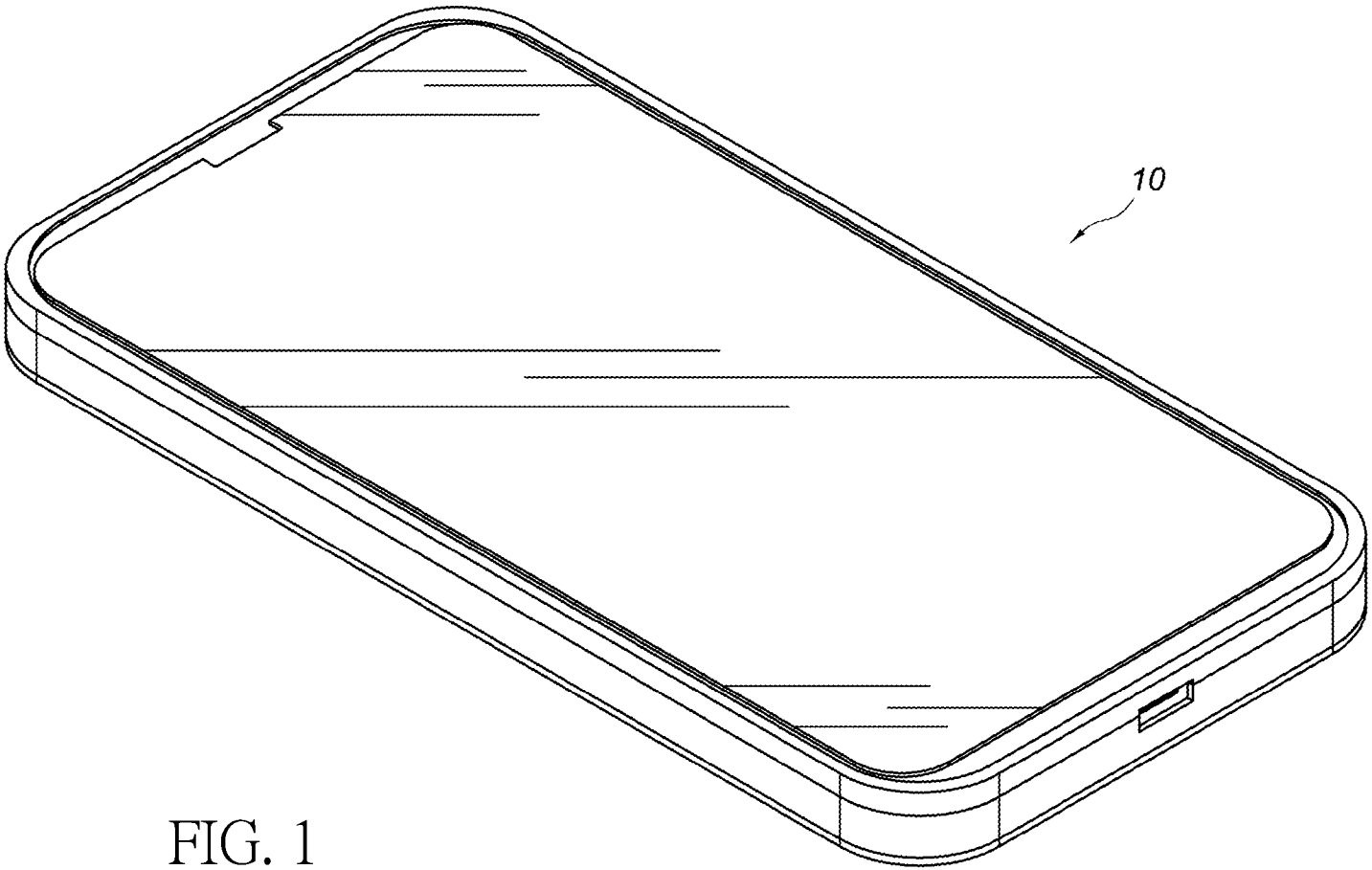
FIG. 1 is a diagram showing a communication device according to an embodiment of the present invention.
Figure 2:
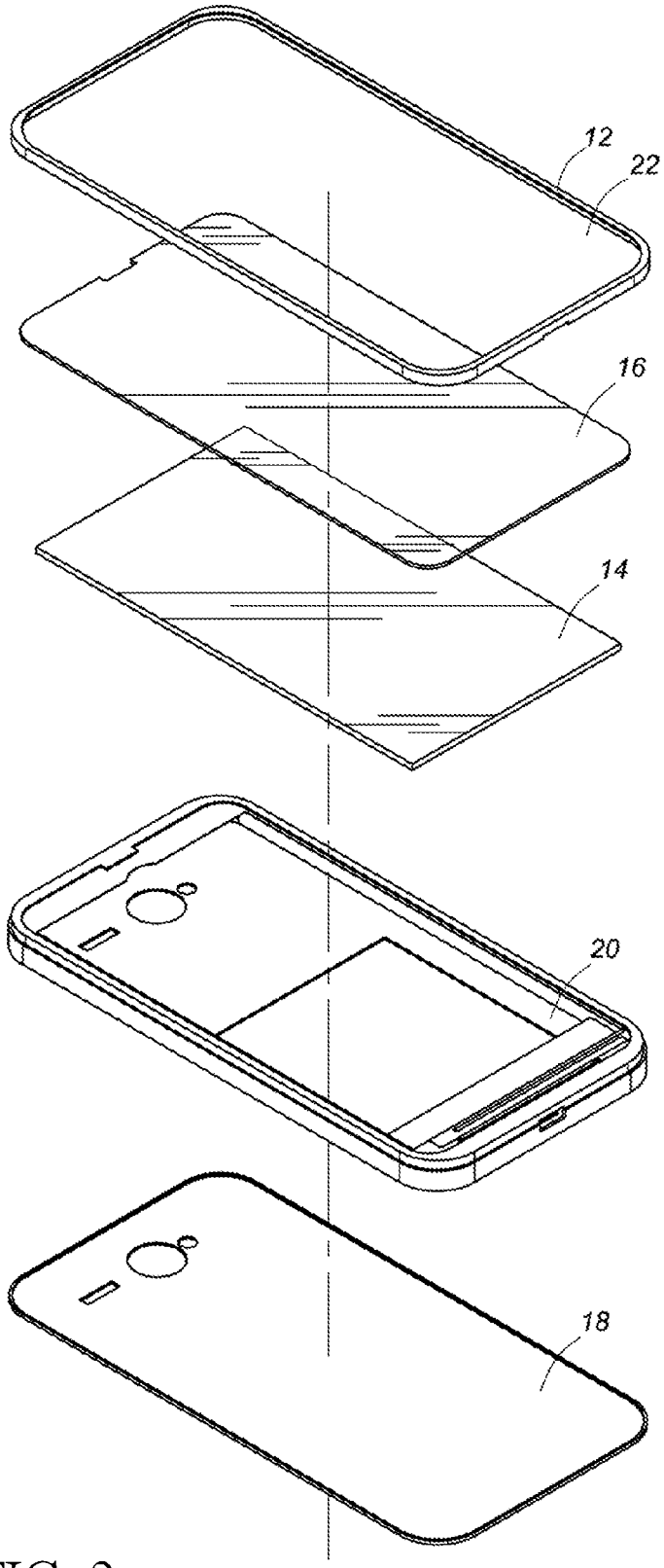
FIG. 2 is an exploded view of the communication device according to the embodiment of the present invention.
Figure 3:
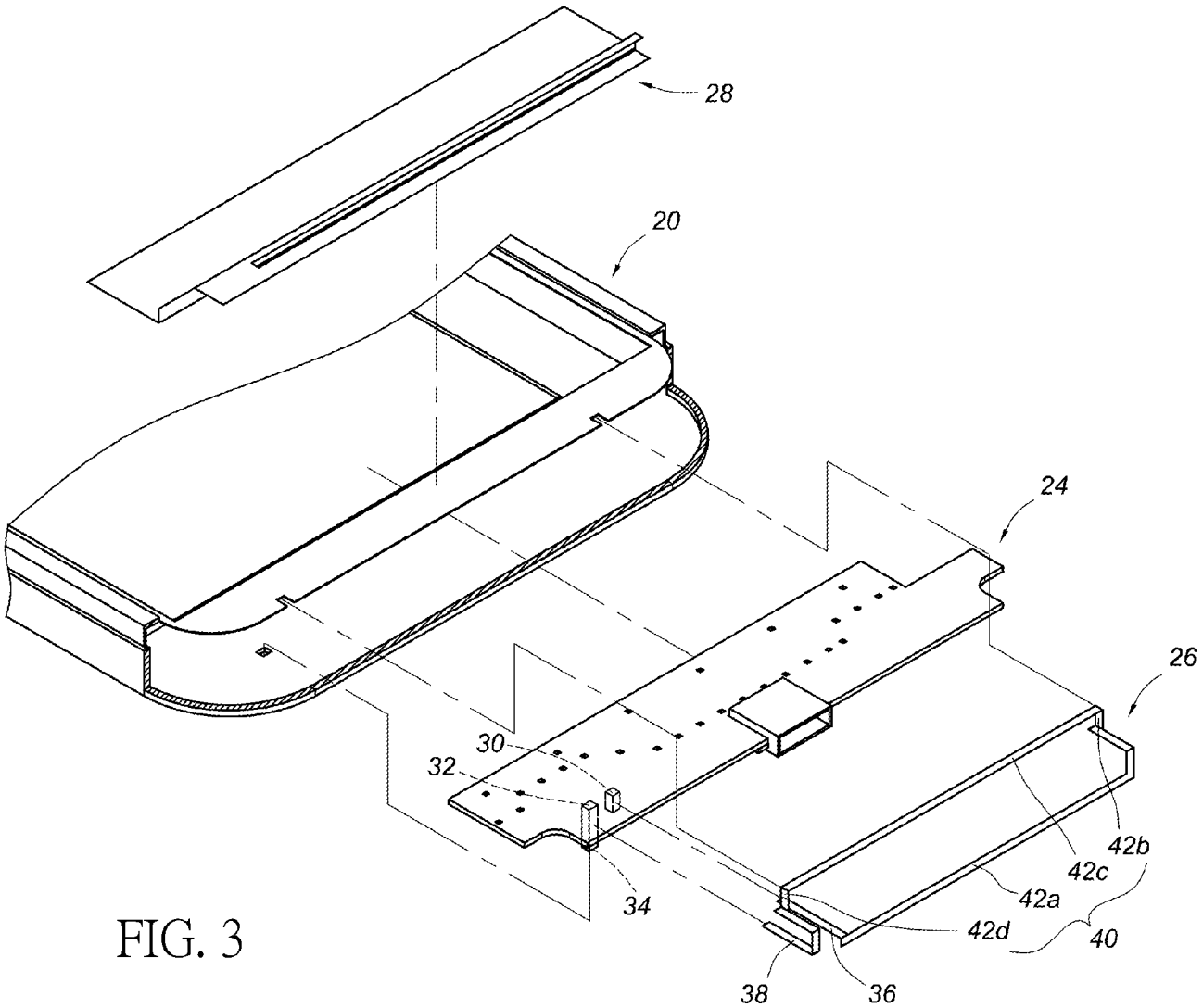
FIG. 3 is an exploded view of arrangement of an antenna of the communication device according to an embodiment of the present invention.
Figure 4:
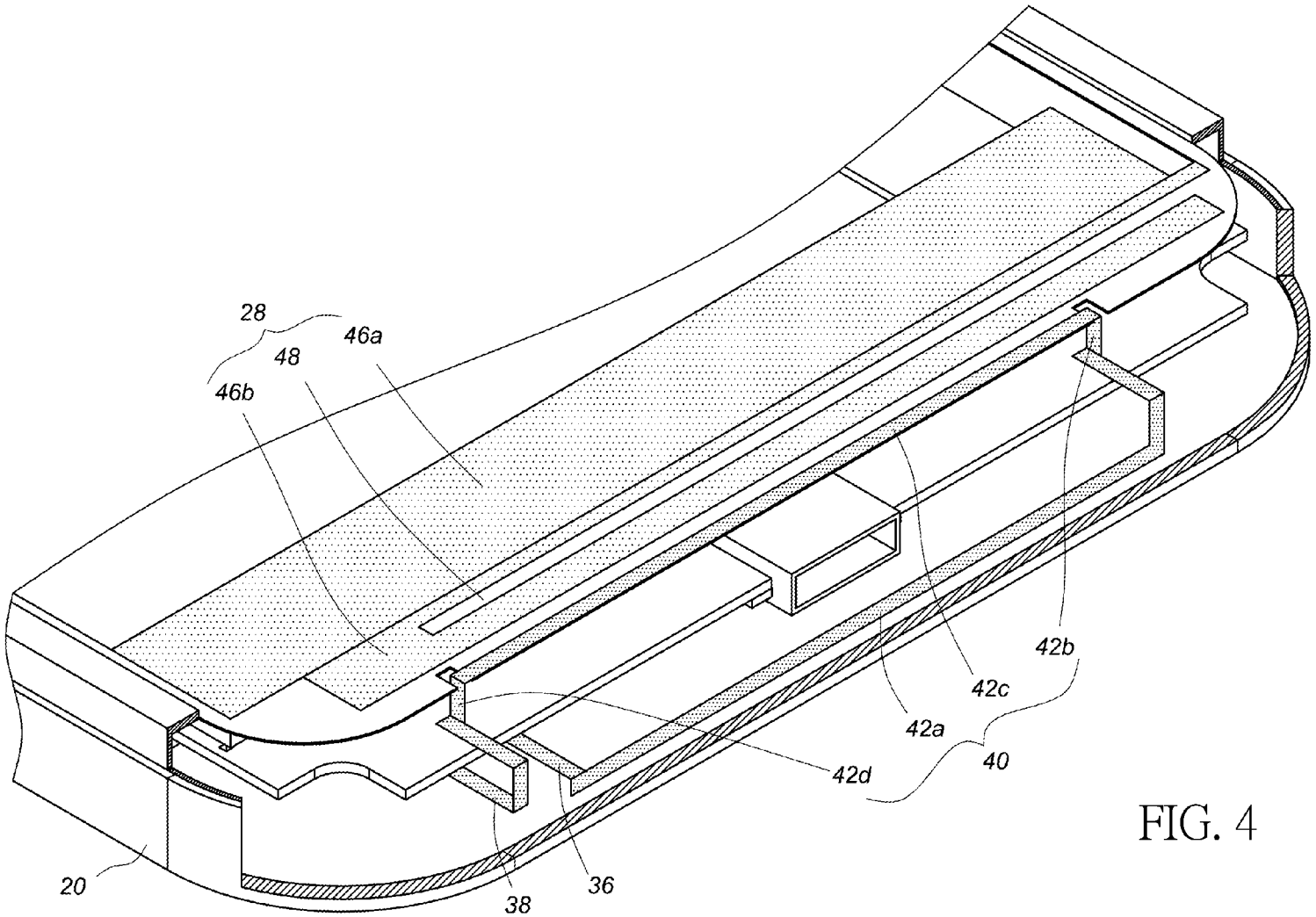
FIG. 4 is a partial enlarged view of the arrangement of the antenna of the communication device according to the embodiment of the present invention.

FIG. 1 and FIG. 2 are diagrams showing a communication device according to an embodiment of the present invention. The communication device 10 comprises a front housing 12, a display module 14, a display panel 16, a back cover 18 and a main body 20. The front housing 12 substantially is a rectangular frame defining a window 22, and the front housing 12 is made of a metal material, but not limited to it. The display panel 16 is installed between the display module 14 and the front housing 12, and corresponds to the window 22 of the front housing 12. The display panel 16 is made of glass, but not limited to it. The back cover is substantially rectangular and located at a position corresponding to the front housing 12. More particularly, the main body 20 is located between the front housing 12 and the back cover 18. In a preferred embodiment, the back cover 18 is made of a metal material, but not limited to it. The back cover 18 can be made of plastic in other embodiment. The back cover 18 is used for installing the display module 14 and the display panel 16 on the main body 20. In addition, the main body 20 is made of a non-conductive material, such as a plastic material, but not limited to it.

FIG. 3 to FIG. 7 are diagrams further showing antenna arrangement of the communication device 10. The antenna arrangement at least comprises a printed circuit board 24, an antenna 26 and a conductor 28.

The printed circuit board 24 is installed on the main body 20, and comprises a signal feed point 30 and a ground point 32. Please note that the printed circuit board 24 can be arranged in other size relative to the main body 20. In other words, the size of the printed circuit board 24 is not limited by the figures.

Figure 5:
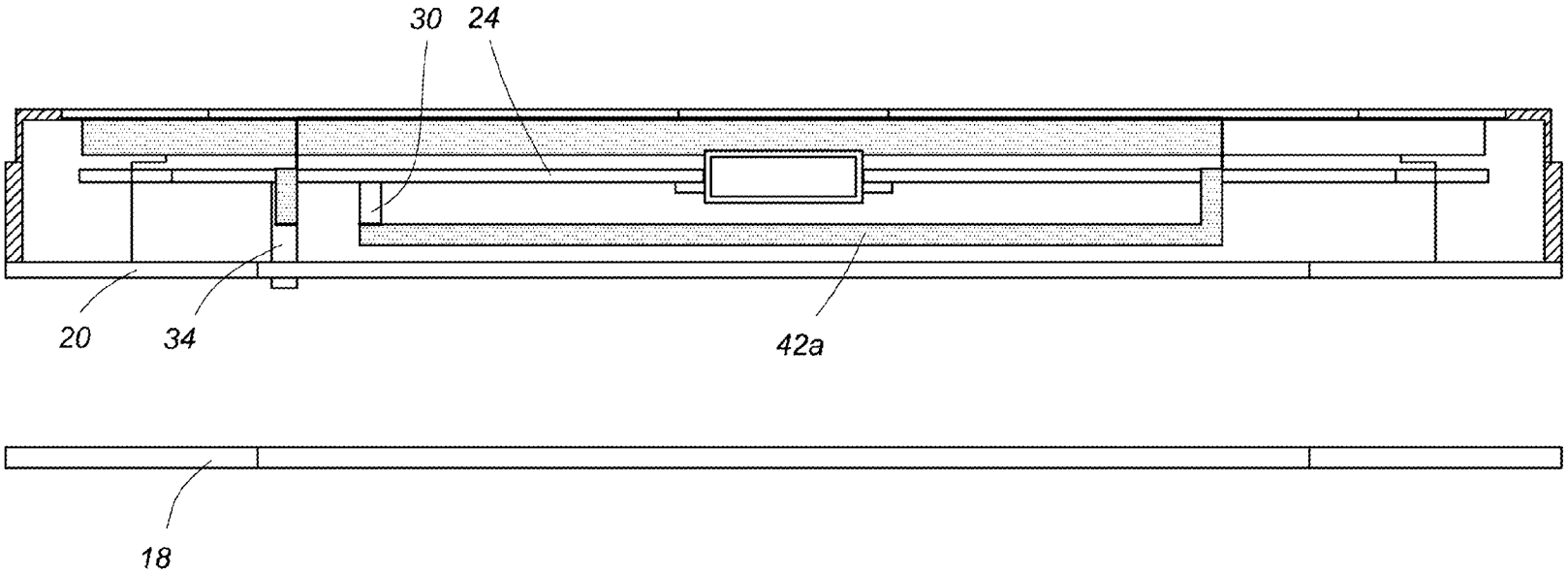
FIG. 5 is a diagram showing arrangement between the back cover and the antenna according to an embodiment of the present invention.
Figure 6:
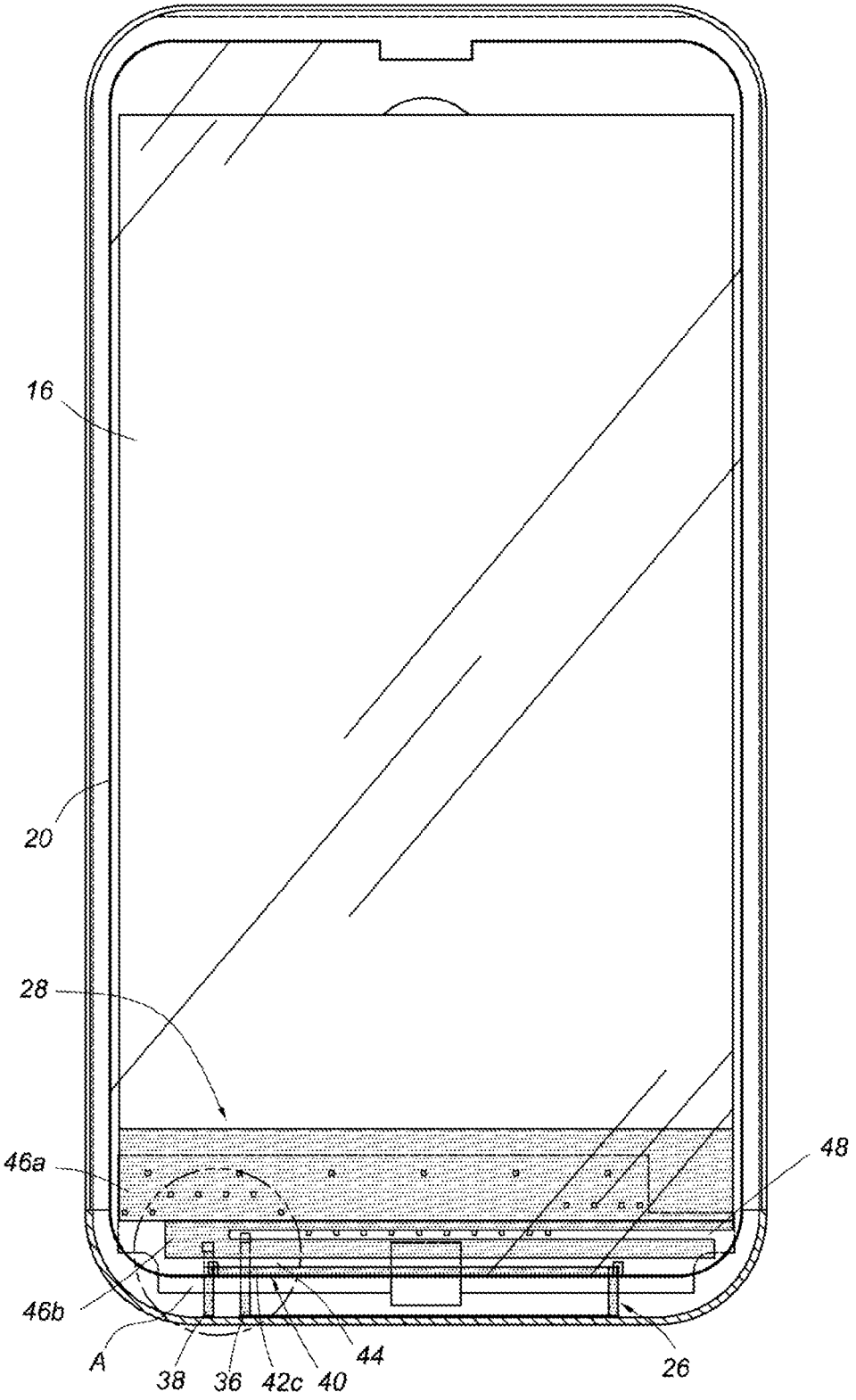
FIG. 6 is a diagram showing arrangement of the communication device according to an embodiment of the present invention.
Figure 7:
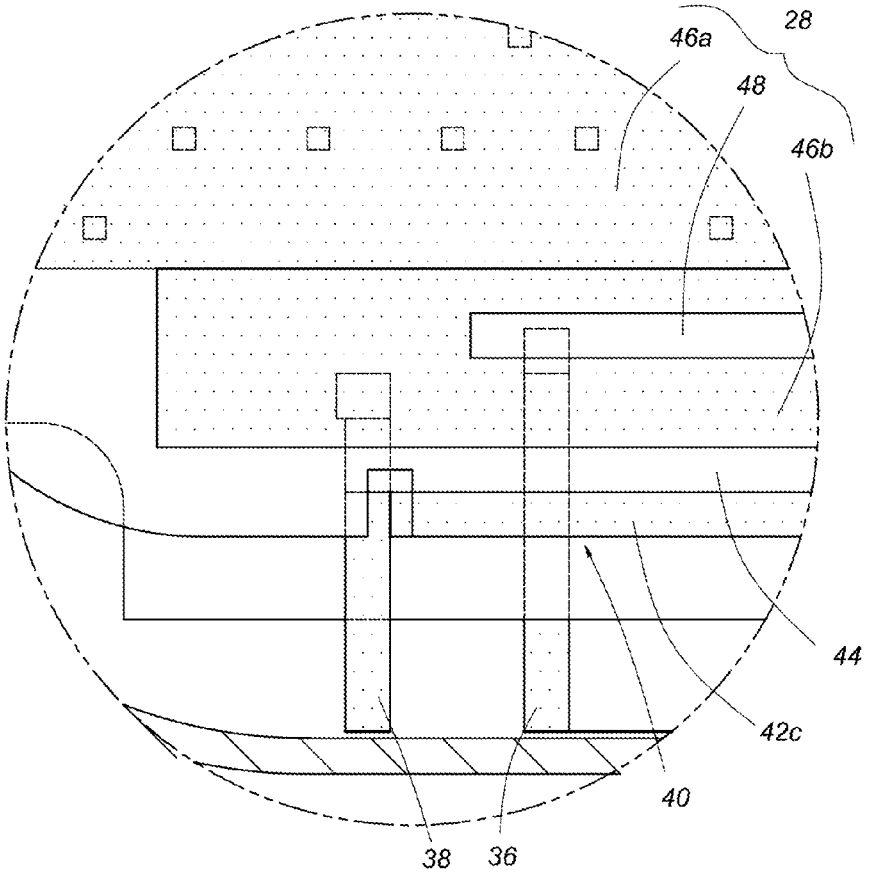
FIG. 7 is an enlarged view of an area A in FIG. 6.

In a preferred embodiment, the communication device 10 further comprises a connection terminal 34 coupled to the ground point 32 of the printed circuit board 24. At least one part of the connection terminal 34 corresponds to the back cover 18, as shown in FIG. 5. Therefore, when the back cover 18 is installed on the main body 20, the back cover 18 contacts the connection terminal 34.

The antenna 26 is installed on the main body 20, and corresponding to an edge of the display panel 16 adjacent to the antenna 26, such as a bottom edge of the display panel 16. The antenna 26 comprises a first metal part 36, a second metal part 38 and a third metal part 40 extended and connected between the first metal part 36 and the second metal part 38. The first metal part 36, the second metal part 38 and the third metal part 40 together form an approximate loop antenna trace, wherein the first metal part 36 is coupled to the signal feed point 30 of the printed circuit board 24, and the second metal part 38 is coupled to the ground point 32 of the printed circuit board 24.

In a preferred embodiment, the third metal part 40 comprises a first wire section 42*a*, a second wire section 42*b*, a third wire section 42*c* and a fourth wire section 42*d*. The first wire section 42*a* is substantially parallel to the back cover 18. The second wire section 42*b* is extended and connected between the first wire section 42*a* and the third wire section 42*c*, and at least one part of the second wire section 42*b* crosses the main body 20 and is substantially perpendicular to the back cover 18, in order to reduce coupling effect between metal parts. The third wire section 42*c* is substantially parallel to the first wire section 42*a*. The fourth wire section 42*d* is connected to the third wire section 42*c*, and at least one part of the fourth wire section 42*d* crosses the main body 20 and is substantially perpendicular to the back cover 18, in order to reduce coupling effect between metal parts as well.

A coupling gap 44 is defined between the conductor 28 and the antenna 26. More particularly, at least one part of the conductor 28 corresponds to the display panel 16, and the coupling gap 44 is defined between the conductor 28 and the third wire section 42*c* of the third metal part 40 of the antenna 26. The coupling gap 44 is substantially smaller than 2 mm. In a preferred embodiment, the conductor 28 comprises a first conductive part 46*a*, a second conductive part 46*b* coupled to the first conductive part 46*a*. A slit 48 is formed on the second conductive part 46*b*. Please note that an area ratio between the first conductive part 46*a* and the second conductive part 46*b* is not limited to an area ratio shown in the figures, the figures only shows a preferred example. One purpose of the conductor 28 of the present invention is to be properly matched with the antenna 26, for adjusting bandwidth. Another purpose of the conductor 28 of the present invention is to guide electromagnetic radiation energy to the display panel 16.

According to the above arrangement, when the communication device 10 is turned on, radiofrequency energy can be transmitted to the antenna 26 and the back cover 18 via the signal feed point 30 and the ground point 32 of the printed circuit board 24, such that the back cover 18 can be utilized as a radiating surface, for transmitting and receiving radio signals of the communication device 10. In addition, the coupling gap 44 can couple energy to the conductor 28. Since the conductor 28 is located at a position corresponding to a part of the display panel 16, even if the back cover 18 is made of plastic, the conductor 28 still can guide radiation energy of the antenna 26 to the display panel 16, so as to improve capability for emitting and receiving radio signals of the communication device 10.

According to the above illustration, efficacies and advantages of the present invention is: the antenna arrangement is applicable to both the metal back cover and the plastic back cover; and when the back cover is made of the metal material, appearance of the back cover is not ruined by design of the antenna, and in contrast to the prior art, the back cover has better appearance and great diversity of design.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A communication device, comprising:

a front housing;

a display module;

a display panel installed between the display module and the front housing;

a back cover made of metal or plastic;

a main body located between the front housing and the back cover, the main body being made of a non-conductive material;

a signal feed point;

a ground point;

an antenna installed on the main body, the antenna comprising a first metal part, a second metal part and a third metal part extended and connected between the first metal part and the second metal part, wherein the first metal part of the antenna is coupled to the signal feed point, and the second metal part of the antenna is coupled to the ground point; and a conductor, wherein a coupling gap is defined between the conductor and the antenna, at least one part of the conductor corresponds to the display panel, the conductor comprises a first conductive part, a second conductive part coupled to the first conductive part, and a slit is formed on the second conductive part.

2. The communication device of claim 1, wherein the front housing substantially is a rectangular frame defining a window, and the display panel corresponds to the window of the front housing.

3. The communication device of claim 2, wherein the front housing is made of a metal material.

4. The communication device of claim 1, wherein the display panel is made of glass.

5. The communication device of claim 1, wherein the back cover is made of a metal material.

6. The communication device of claim 5, wherein the back cover is coupled to the ground point.

7. The communication device of claim 1, wherein the first metal part, the second metal part and the third metal part of the antenna together form an approximate loop antenna trace.

8. The communication device of claim 1, wherein the antenna corresponds to an edge of the display panel adjacent to the antenna.

9. The communication device of claim 1, wherein the third metal part of the antenna comprises a first wire section, a second wire section, a third wire section and a fourth wire section, wherein the first wire section is substantially parallel to the back cover, the second wire section is extended and connected between the first wire section and the third wire section, at least one part of the second wire section crosses the main body and is substantially perpendicular to the back cover, the fourth wire section is connected to the third wire section, at least one part of the fourth wire section crosses the main body and is substantially perpendicular to the back cover.

10. The communication device of claim 1 further comprising a connection terminal coupled to the ground point, wherein at least one part of the connection terminal corresponds to the back cover, when the back cover is installed on the main body, the back cover contacts the connection terminal.

11. A communication device antenna, comprising:

a back cover made of metal or plastic;

a main body made of a non-conductive material;

a printed circuit board installed on the main body, the printed circuit board comprising a signal feed point and a ground point;

an antenna installed on the main body, the antenna comprising a first metal part and a second metal part, wherein the first metal part of the antenna is coupled to the signal feed point of the printed circuit board, and the second metal part of the antenna is coupled to the ground point, which is coupled to the back cover; and a conductor, wherein a coupling gap is defined between the conductor and the antenna, the conductor comprises a first conductive part, a second conductive part coupled to the first conductive part, and a slit is formed on the second conductive part.

12. The communication device antenna of claim 11, wherein the antenna further comprises a third metal part extended and connected between the first metal part and the second metal part, the first metal part, the second metal part and the third metal part together form an approximate loop antenna trace.

* * * * *